US008576127B1

(12) United States Patent
Wolf et al.

(10) Patent No.: US 8,576,127 B1
(45) Date of Patent: Nov. 5, 2013

(54) UWB MIMO BROADBAND ANTENNA SYSTEM FOR HANDHELD RADIO

(75) Inventors: Jeremiah D Wolf, Marion, IA (US); Lee M Paulsen, Cedar Rapids, IA (US); Mark A Willi, Marion, IA (US); James B West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 291 days.

(21) Appl. No.: 13/193,842

(22) Filed: Jul. 29, 2011

(51) Int. Cl.
*H01Q 1/24* (2006.01)

(52) U.S. Cl.
USPC ..... 343/702; 343/876

(58) Field of Classification Search
USPC ..... 343/702, 876, 893
See application file for complete search history.

(56) References Cited

U.S. PATENT DOCUMENTS 6,873,293 B2 * 3/2005 Proctor et al. ..... 343/702
7,190,313 B2 * 3/2007 Chiang et al. ..... 343/702
7,525,493 B2 * 4/2009 Iwai et al. ..... 343/702

* cited by examiner

*Primary Examiner* — Hoang V Nguyen
(74) *Attorney, Agent, or Firm* — Donna P. Suchy; Daniel M. Barbieri

(57) ABSTRACT

The present invention is directed to antenna system embodiments which allow for hand-held, ultra-wideband (UWB) multi-antenna operation to be realized within the severe size constraints necessary for Department of Defense (DOD) hand-held missions. Further, the antenna system embodiments disclosed herein provide a miniature UWB multiple antenna solution for multiple-input and multiple-output (MIMO) and radiation pattern null steering suitable for hand-held soldier radios.

20 Claims, 3 Drawing Sheets

UWB MIMO BROADBAND ANTENNA SYSTEM FOR HANDHELD RADIO

FIELD OF THE INVENTION

The present invention relates to the field of antenna systems and particularly to an ultra-wideband (UWB) multiple-input and multiple-output (MIMO) broadband antenna system for handheld radio.

BACKGROUND OF THE INVENTION

Currently available antenna solutions for hand-held soldier radios do not provide a desired level of performance. For example, traditional whip (ex.—monopole) antennas, which are often implemented in hand-held soldier radios, may not be ideal for implementation in hand-held soldier radios for the following reasons: 1) they are of an impractically large size given the severe size constraints presented by hand-held soldier radios; 2) they provide narrow impedance-matched bandwidth; 3) they provide extremely low gain and/or low radiation efficiency; and 4) when multiple antennas are implemented, they experience parasitic mutual coupling between the multiple antennas.

Thus, it would be desirable to provide an antenna solution for hand-held soldier radios which obviates the problems associated with currently available solutions.

SUMMARY OF THE INVENTION

Accordingly, an embodiment of the present invention is directed to a communication device, including: a chassis; a plurality of antenna elements, the plurality of antenna elements being connected to the chassis, at least one antenna element included in the plurality of antenna elements being a segmented, ultra-wideband bi-rolled monopole antenna element; and a control interface, the control interface being connected to the chassis and being communicatively coupled with the plurality of antenna elements, wherein the communication device is a hand-held, mobile, wireless communication device configured for transmitting and receiving signals via the plurality of antenna elements.

A further embodiment of the present invention is directed to a communication device, including: a RF radio chassis; a plurality of antenna elements, the plurality of antenna elements being connected to the chassis, at least one antenna element included in the plurality of antenna elements being a segmented, ultra-wideband bi-rolled monopole antenna element, the at least one antenna element including a first octave element and a second octave element, the first octave element configured for tuning over a first frequency band, the second octave element configured for tuning over a second frequency band, the first frequency band being different from the second frequency band, the at least one antenna element further including a switching structure, the switching structure being configured between the first octave element and the second octave element, the at least one antenna element configured for tuning over an aggregate frequency band, the aggregate frequency band including the first frequency band and the second frequency band, the at least one antenna element configured for being selectively established in a first setting or a second setting via the switching structure; and a control interface, the control interface being connected to the chassis and being communicatively coupled with the plurality of antenna elements, the control interface being a smartphone control interface, wherein the communication device is a hand-held, mobile, wireless radio device configured for transmitting and receiving signals via the plurality of antenna elements, the plurality of antenna elements providing two modes of azimuth beam steering.

A still further embodiment of the present invention is directed to a communication device, including: a RF radio chassis; a plurality of antenna elements, the plurality of antenna elements being connected to the chassis, at least one antenna element included in the plurality of antenna elements being a segmented, ultra-wideband bi-rolled monopole antenna element, the at least one antenna element including a first octave element and a second octave element, the first octave element configured for tuning over a first frequency band, the second octave element configured for tuning over a second frequency band, the first frequency band being different from the second frequency band, the at least one antenna element further including a switching structure, the switching structure being configured between the first octave element and the second octave element, the at least one antenna element configured for tuning over an aggregate frequency band, the aggregate frequency band including the first frequency band and the second frequency band, the at least one antenna element configured for being selectively established in a first setting or a second setting via the switching structure; and a control interface, the control interface being connected to the chassis and being communicatively coupled with the plurality of antenna elements, the control interface being a smartphone control interface, wherein the communication device is a hand-held, mobile, wireless radio device configured for transmitting and receiving signals via the plurality of antenna elements, the plurality of antenna elements providing two modes of azimuth beam steering, a first pair of antenna elements included in the plurality of antenna elements being located at a first end of the chassis and a second pair of antenna elements included in the plurality of antenna elements being located at a second end of the chassis.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Traditional whip (ex.—monopole) antennas, such as broadband whip antennas (ex.—rubber duck antennas), Very High Frequency (VHF) blade antennas, Ultra High Frequency (UHF) whip antennas, monofilar helical monopoles and/or miniature microstrip patches, may have a number of drawbacks. For instance, traditional whip antennas may be excessively large in size (ex.—may have an excessively large footprint), thus making them impractical for multi-antenna applications. Further, traditional whip antennas may have a narrow impedance matched bandwidth. Still further, traditional whip antennas may have extremely low gain and/or radiation efficiency. Further, when multiple traditional whip antennas are implemented together, parasitic mutual coupling between the antennas may occur.

The antenna system embodiments disclosed herein allow for hand-held, ultra-wideband (UWB) multi-antenna operation to be realized within the severe size constraints necessary for Department of Defense (DOD) hand-held missions. Further, the antenna system embodiments disclosed herein provide a miniature UWB multiple antenna solution for MIMO and radiation pattern null steering suitable for hand-held soldier radios.

Referring generally to FIG. 1A through FIG. 3, a communication device 100 in accordance with an exemplary embodiment of the present disclosure is shown. In further embodiments, the communication device 100 may be a mobile communication device, such as a hand-held communication device and/or a wireless communication device. In still further embodiments, the mobile communication device 100 may be configured for receiving and/or transmitting signals (ex.—may be a transceiver). In further embodiments, the mobile communication device 100 may be a radio system configured for transmitting and/or receiving radio communications and/or radio signals. For instance, the radio system may be a soldier radio system, such as a hand-held soldier radio system. In exemplary embodiments of the present disclosure, the mobile communication device 100 may be a phone system, such as a mobile phone system. In further embodiments, the mobile communication device 100 may be a mobile smart communication device. For example, the mobile smart communication device 100 may be a digital, active, computer networked, and/or user-reconfigurable device. In still further embodiments, the mobile smart communication device 100 may be a smartphone. For instance, the smartphone 100 may be defined as a mobile phone which offers more advance computing ability and connectivity than a contemporary feature phone, and may be further defined as a hand-held computer integrated with a mobile telephone. In further embodiments, the mobile communication device 100 may be, may include and/or may incorporate any combination of the above.

Figure 1A:
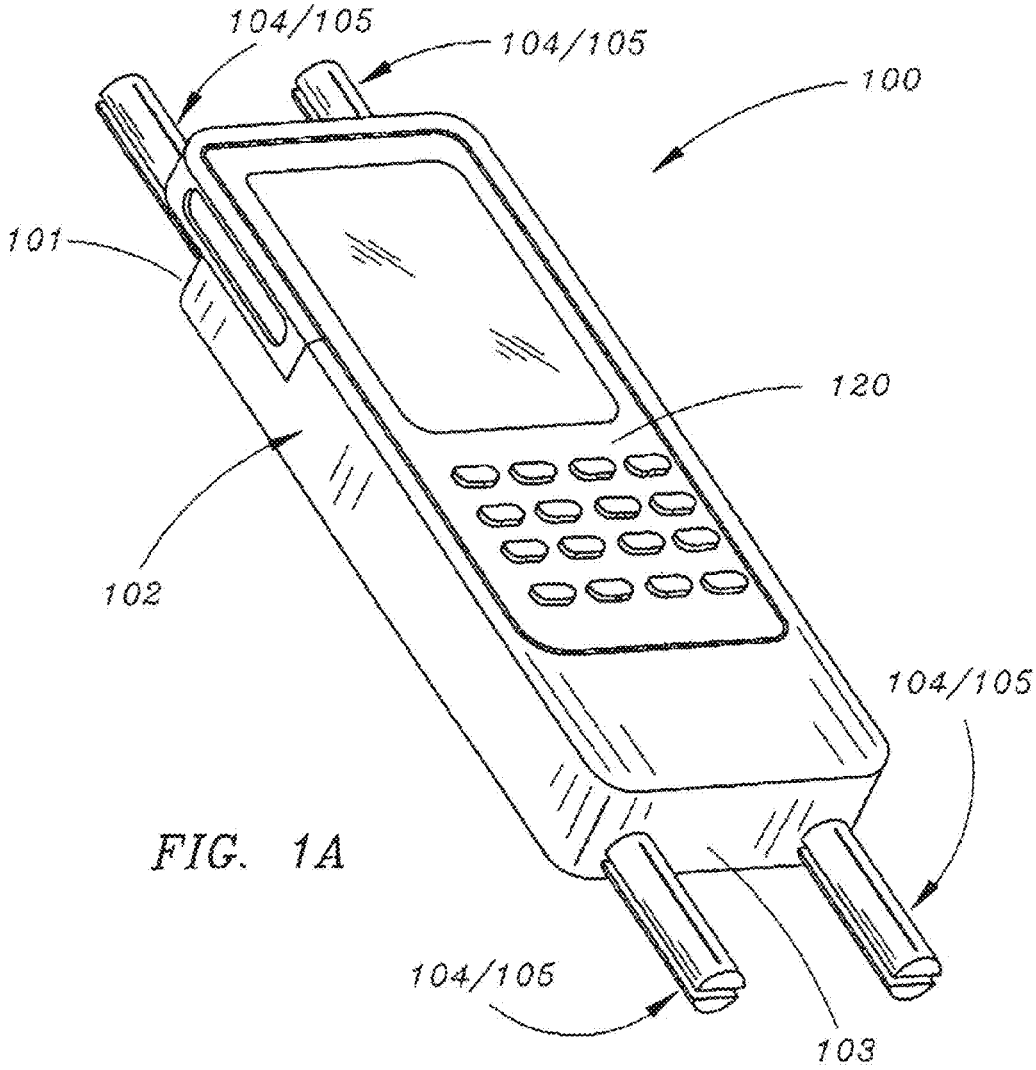
FIG. 1A is a an isometric view of a communication device, in accordance with an exemplary embodiment of the present invention, the view showing a close-up sectional view of an antenna element and antenna enclosure portion of the device.
Figure 1B:
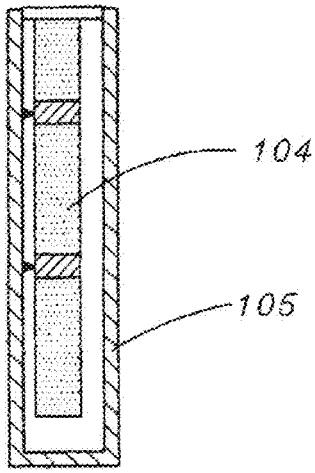
FIG. 1B is a sectional view of the antenna element and antenna enclosure which may be included as part of the communication device shown in FIG. 1A
Figure 2:
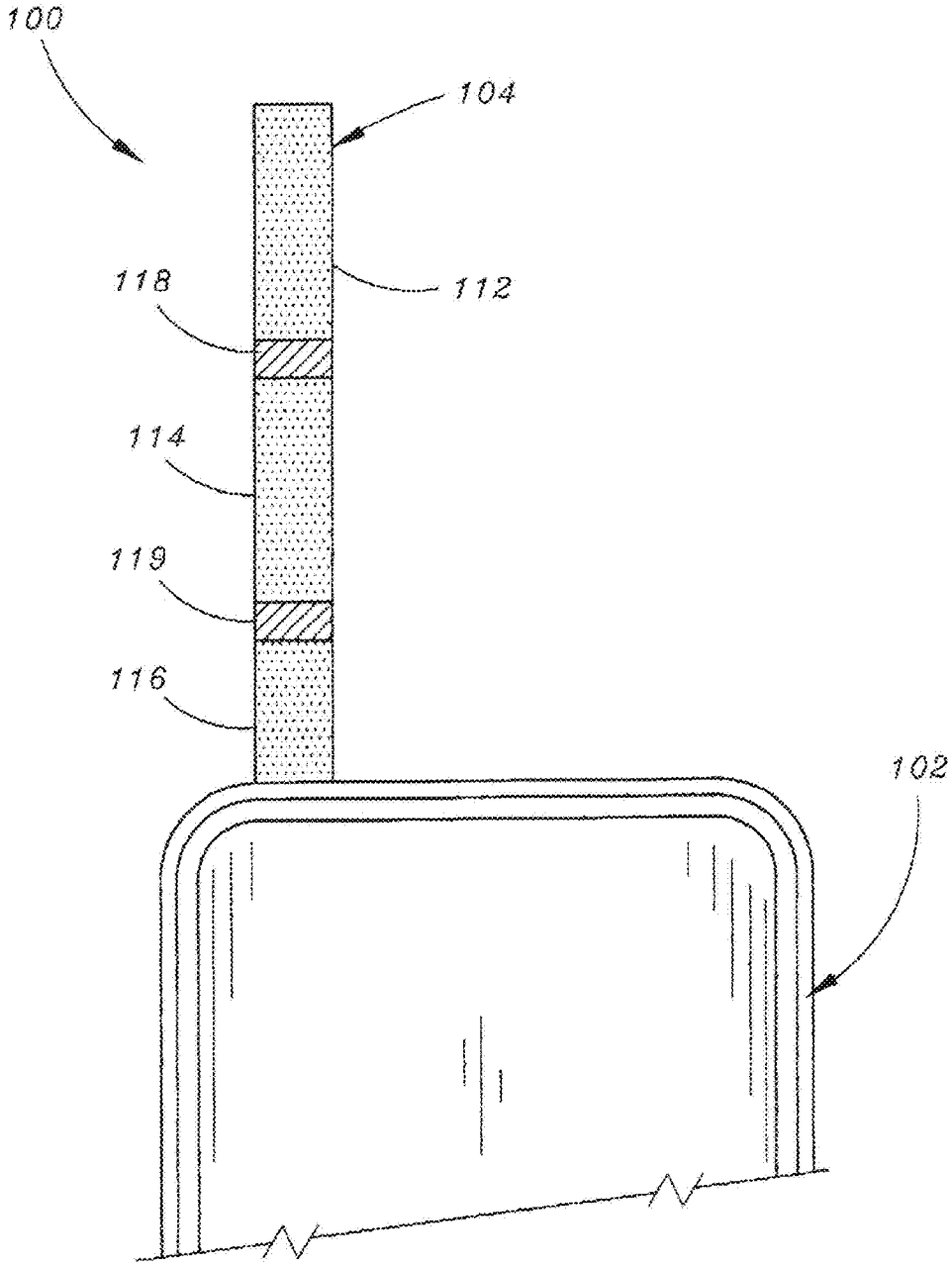
FIG. 2 is a view of the communication device shown in FIG. 1A in accordance with a further exemplary embodiment of the present invention, in which an antenna element (with the antenna enclosure removed) is shown.
Figure 3:
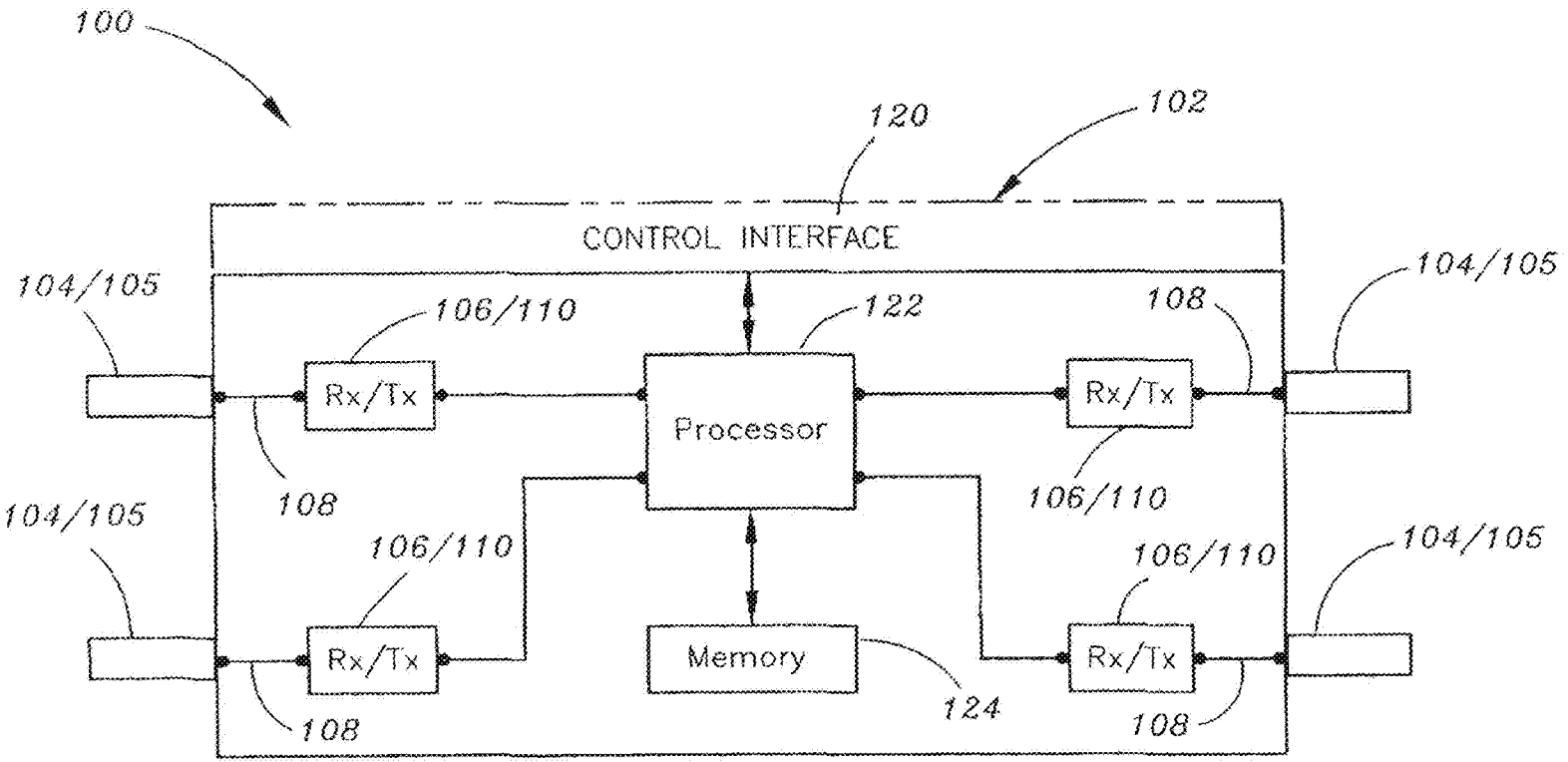
FIG. 3 is a block diagram schematic of the communication device of FIG. 1A, in accordance with a further exemplary embodiment of the present invention.

In an embodiment of the present disclosure, the communication device 100 includes a body portion (ex.—chassis) 102. For instance, the chassis 102 may be a Radio Frequency (RF) radio chassis (ex.—a soldier radio system chassis). In further embodiments, the communication device 100 may include a plurality of antennas (ex.—antenna elements; metallic conductors) 104. The plurality of antennas 104 may be connected to the chassis 102. For example, as shown in FIG. 1A, the plurality of antennas 104 may include four antennas, with two of the four antennas being connected to a first end (ex.—top end) 101 of the chassis 102 and the other two of the four antennas being connected to a second end (ex.—bottom end) 103 of the chassis 102. In still further embodiments, antenna(s) included in the plurality of antennas 104 may be RF antennas. In further embodiments, antenna(s) included in the plurality of antennas 104 may be configured for transmitting and/or receiving signals (ex.—electromagnetic energy, RF signals).

In exemplary embodiments of the present disclosure, the communication device 100 may include one or more receivers 106 which may be electrically connected (via one or more electrical connections (ex.—transmission lines) 108 to the plurality of antennas 104 and may be configured for receiving electromagnetic energy via the plurality of antennas 104. In further embodiments, the communication device 100 may include one or more transmitters 110 which may be electrically connected (via one or more electrical connections (ex.—transmission lines) 108 to the plurality of antennas 104 and may be configured for transmitting electromagnetic energy via the plurality of antennas 104. In still further embodiments, the receivers 106 and/or transmitters 110 may be at least substantially contained within the chassis 102. In further embodiments, the receiver(s) 106 and transmitter(s) 110 may be communicatively coupled with each other.

In an embodiment of the present disclosure, each antenna included in the plurality of antennas 104 may be configured to operate independently of the other antennas included in the plurality of antennas 104. As mentioned above, the plurality of antennas 104 may be connected to the chassis 102. For example, the plurality of antennas 104 may be spring-loaded antennas, such that the plurality of antennas 104 may be configured for being alternately retracted into or drawn out from an interior area of the chassis 102. When the plurality of antennas 104 are drawn out (or extended out) from the interior area of the chassis (as shown in FIG. 1A), the plurality of antennas 104 are in a deployed position. In further embodiments, each antenna included in the plurality of antennas 104 may be connected to an enclosure portion 105, the enclosure portion at least partially and/or at least substantially enclosing the antenna 104, the enclosure portion 105 configured for retracting into and/or extending from the chassis along with the antenna 104.

In exemplary embodiments of the present disclosure, the plurality of antennas 104 may be capable of tuning over a wide frequency band. For example, the frequency band over which the plurality of antennas 104 may be capable of tuning over a frequency band ranging from 0.9 Gigahertz (GHz) to 6.0 GHz. In further embodiments, the frequency band range over which the antennas 104 may be capable of tuning may have an upper limit as high as 10.0 GHz. In still further embodiments, the plurality of antennas 104 may be configured for ultra-wideband (UWB) communications (ex.—may be UWB antennas). In further embodiments, the plurality of antennas 104 may be multiple-input multiple-output (MIMO) antennas (ex.—may be implemented as part of a UWB MIMO system).

In an embodiment of the present disclosure, antenna(s) included in the plurality of antennas 104 may be configured as bi-rolled (ex.—bi-arm rolled; bi-arm roll) UWB monopole antennas. In further embodiments, antenna(s) included in the plurality of antennas 104 may be segmented antennas. In still further embodiments, antenna(s) included in the plurality of antennas 104 may have a mechanical implementation (ex.—may be configured) similar to a stub whip antenna.

As mentioned above, the plurality of antennas 104 may be capable of tuning over a frequency band ranging from 0.9 Gigahertz (GHz) to 6.0 GHz. This may occur via one of three different tunable (ex.—switched) settings. In an embodiment of the present disclosure, each antenna included in the plurality of antennas 104 may include multiple segments (ex.—multiple sections, a plurality of octave elements). For example, each antenna included in the plurality of antennas 104 may include a first octave element 112, a second octave element 114 and a third octave element 116. In exemplary embodiments, the first octave element 112 may be configured for tuning over a first portion of the frequency band range of the antenna 104, the second octave element 114 may be configured for tuning over a second portion of the frequency band range of the antenna 104, and the third octave element 116 may be configured for tuning over a third portion of the frequency band range of the antenna 104. For example, if the frequency band range for the antenna is 0.9 GHz to 6.0 GHz, the first octave element 112 may be configured for tuning over a frequency band (ex.—may be configured for operating over an octave operational region) ranging from 0.9 to 2.0 GHz, the second octave element 114 may be configured for tuning over a frequency band ranging from 2.0 to 4.5 GHz, and the third octave element 116 may be configured for tuning over a frequency band ranging from 4.5 GHz to 6.0 GHz. In further embodiments, each antenna 104 may include one or more switching structures (ex.—switchers). For example, in the illustrated embodiments, antenna 104 is shown as having a first switching structure 118 and a second switching structure 119. The first switching structure 118 may be configured (ex.—connected) between the first octave element 112 and the second octave element 114. The second switching structure 119 may be configured (ex.—connected) between the second octave element 114 and the third octave element 116. In still further embodiments, each antenna 104 may be configured for providing wideband functionality and tuning over the aggregate frequency band (ex.—0.9 GHz to 6.0 GHz) by switching antenna sections (112, 114, 116) via the switching structures (118, 120) across the aggregate band. Thus, each antenna 104 may be configured for tuning over its aggregate frequency band (ex.—0.9 to 6.0 GHz) via one of multiple (ex.—three) different tunable (ex.—switched) settings (ex.—octave operational regions). For instance, an antenna included in the plurality of antennas 104 may be configured for providing an octave of instantaneous bandwidth for any one of its multiple tunable settings (ex.—any one of its three octave operational regions: (0.9-2.0 GHz; 2.0-4.5 GHz; and 4.5-6.0 GHz). Further, the antennas 104 may provide a greater than 6:1 ratio of instantaneous bandwidth. Thus, the antennas 104 described herein extend bi-rolled monopole natural self matched bandwidth by switching antenna sections across the aggregate band, thereby eliminating the need for any RF matching or switching networks and reducing loss.

In exemplary embodiments of the present disclosure, the plurality of antennas 104 is configured for providing beam steering, radiation pattern null steering, and/or nulling in azimuth. In further embodiments, two modes of azimuth beam steering (ex.—dual-band beam steering) may be provided via top-bottom adjacent antenna pairs 118 included in the plurality of antennas 104. In still further embodiments, the plurality of antennas 104 may provide beam steering with greater than ten decibels of interference suppression and may provide gain greater than six decibels. In further embodiments, the chassis 102 may provide greater than twenty-three decibels of antenna-to-antenna isolation between antennas of a top-bottom antenna pair 118 included in the plurality of antennas 104. Further, the chassis 102 may provide greater than eleven decibels of antenna-to-antenna isolation between adjacent antenna sets (ex.—between top-bottom antenna pairs 118) included in the plurality of antennas 104.

In further embodiments of the present disclosure, antenna (s) included in the plurality of antennas 104 may be configured as any one of a number of antenna structures and/or antenna elements included in a family of modified UWB elements (ex.—planar UWB bulbous monopoles). In still further embodiments, antenna(s) included in the plurality of antennas 104 may be configured with perimeter edge serrations and/or slots internal to the antenna structure for promoting an increase in RF current path to reduce the antenna's lowest operating frequency for a fixed size of the antenna. In further embodiments, the chassis 102 may be sized for use in the hand-held communication device 100, while the antennas 104 may also be accordingly sized (ex.—two inches long) for use in the hand-held communication device 100.

In embodiments of the present disclosure, the communication device 100 may further include a control interface 120. The control interface 120 may be integrated with the chassis 102. For example, the control interface 120 may be a smartphone-compatible control interface (ex.—a smartphone control interface). In still further embodiments, the control interface 120 may be configured for allowing a user of the communication device 100 to interact with the device 100. For instance, the control interface 120 may be or may include: one or more user input devices (ex.—buttons, switches, microphones, etc.); one or more audio output devices and/or video output devices (ex.—speakers, display); a control panel; a graphical user interface (GUI); and/or a touch screen.

In further embodiments of the present disclosure, the communication device 100 may further include a processor 122. The processor 122 may be configured for being communicatively coupled to the control interface 120. In still further embodiments, the communication device 100 may further include a memory 124, the memory 124 being communicatively coupled to the processor 122. In further embodiments, data inputs and data outputs may be routed between the control interface 120, the processor 122, and the memory 124 for realizing the functionality of the communication device 100. Still further, the control interface 120, the processor 122, the memory 124, the transmitters 110, the receivers 106, and the antennas 104 may be communicatively coupled for realizing the functionality of the communication device 100. In further embodiments, hardware, software, and/or firmware may be implemented by the communication device 100 for realizing the functionality of the communication device 100. For instance, the communication device 100 (ex.—a soldier system) may implement an open systems approach which utilizes standard smartphone operating system(s) in order to take advantage of third party and mobile device software. In still further embodiments, the communication device 100 may be configured for implementation in Advanced Wireless Networks for the Soldier (AWNS).

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A communication device, comprising:

a chassis;

a plurality of antenna elements, the plurality of antenna elements being connected to the chassis, at least one antenna element included in the plurality of antenna elements being a segmented, ultra-wideband bi-rolled monopole antenna element; and a control interface, the control interface being connected to the chassis and being communicatively coupled with the plurality of antenna elements, wherein the communication device is a hand-held, mobile, wireless communication device configured for transmitting and receiving signals via the plurality of antenna elements.

2. A communication device as claimed in claim 1, wherein the communication device is a radio system.

3. A communication device as claimed in claim 1, wherein the chassis is a Radio Frequency (RF) radio chassis.

4. A communication device as claimed in claim 1, wherein the at least one antenna element included in the plurality of antenna elements includes a first octave element and a second octave element, the first octave element configured for tuning over a first frequency band, the second octave element configured for tuning over a second frequency band, the first frequency band, and the second frequency band being different frequency bands.

5. A communication device as claimed in claim 4, wherein the at least one antenna element included in the plurality of antenna elements includes a switching structure, the switching structure being configured between the first octave element and the second octave element.

6. A communication device as claimed in claim 5, wherein the at least one antenna element is configured for tuning over an aggregate frequency band, the aggregate frequency band including the first frequency band and the second frequency band.

7. A communication device as clamed in claim 6, wherein the aggregate frequency band includes frequencies ranging from 0.9 Gigahertz to 10.0 Gigahertz.

8. A communication device as claimed in claim 5, wherein the at least one antenna element is configured for being selectively established in a first setting or a second setting via the switching structure.

9. A communication device as claimed in claim 8, wherein when the at least one antenna element is established in the first setting, the at least one antenna element tunes over the first frequency band via the first octave element.

10. A communication device as claimed in claim 8, wherein when the at least one antenna element is established in the second setting, the at least one antenna element tunes over the second frequency band via the second octave element.

11. A communication device as claimed in claim 1, wherein the plurality of antenna elements provides two modes of azimuth beam steering.

12. A communication device as clamed in claim 1, wherein the communication device is a mobile smart device.

13. A communication device as claimed in claim 1, wherein the control interface is a smartphone control interface.

14. A communication device as claimed in claim 1, wherein the plurality of antenna elements are connected to the chassis via spring-loaded connections.

15. A communication device as claimed in claim 1, wherein a first pair of antenna elements included in the plurality of antenna elements are located at a first end of the chassis and a second pair of antenna elements included in the plurality of antenna elements are located at a second end of the chassis.

16. A communication device as claimed in claim 1, wherein the plurality of antenna elements are multiple-input and multiple-output (MIMO) antenna elements.

17. A communication device, comprising:

a RF radio chassis;

a plurality of antenna elements, the plurality of antenna elements being connected to the chassis, at least one antenna element included in the plurality of antenna elements being a segmented, ultra-wideband bi-rolled monopole antenna element, the at least one antenna element including a first octave element and a second octave element, the first octave element configured for tuning over a first frequency band, the second octave element configured for tuning over a second frequency band, the first frequency band being different from the second frequency band, the at least one antenna element further including a switching structure, the switching structure being configured between the first octave element and the second octave element, the at least one antenna element configured for tuning over an aggregate frequency band, the aggregate frequency band including the first frequency band and the second frequency band, the at least one antenna element configured for being selectively established in a first setting or a second setting via the switching structure; and a control interface, the control interface being connected to the chassis and being communicatively coupled with the plurality of antenna elements, the control interface being a smartphone control interface, wherein the communication device is a hand-held, mobile, wireless radio device configured for transmitting and receiving signals via the plurality of antenna elements, the plurality of antenna elements providing two modes of azimuth beam steering.

18. A communication device as claimed in claim 17, wherein when the at least one antenna element is established in the first setting, the at least one antenna element tunes over the first frequency band via the first octave element; and when the at least one antenna element is established in the second setting, the at least one antenna element tunes over the second frequency band via the second octave element.

19. A communication device, comprising:

a RF radio chassis;

a plurality of antenna elements, the plurality of antenna elements being connected to the chassis, at least one antenna element included in the plurality of antenna elements being a segmented, ultra-wideband bi-rolled monopole antenna element, the at least one antenna element including a first octave element and a second octave element, the first octave element configured for tuning over a first frequency band, the second octave element configured for tuning over a second frequency band, the first frequency band being different from the second frequency band, the at least one antenna element further including a switching structure, the switching structure being configured between the first octave element and the second octave element, the at least one antenna element configured for tuning over an aggregate frequency band, the aggregate frequency band including the first frequency band and the second frequency band, the at least one antenna element configured for being selectively established in a first setting or a second setting via the switching structure; and a control interface, the control interface being connected to the chassis and being communicatively coupled with the plurality of antenna elements, the control interface being a smartphone control interface, wherein the communication device is a hand-held, mobile, wireless radio device configured for transmitting and receiving signals via the plurality of antenna elements, the plurality of antenna elements providing two modes of azimuth beam steering, a first pair of antenna elements included in the plurality of antenna elements being located at a first end of the chassis and a second pair of antenna elements included in the plurality of antenna elements being located at a second end of the chassis.

20. A communication device as claimed in claim 19, wherein when the at least one antenna element is established in the first setting, the at least one antenna element tunes over the first frequency band via the first octave element; and when the at least one antenna element is established in the second setting, the at least one antenna element tunes over the second frequency band via the second octave element.

* * * * *